US007552974B2

(12) United States Patent
Babikian et al.

(10) Patent No.: US 7,552,974 B2
(45) Date of Patent: Jun. 30, 2009

(54) HIGH CHAIR

(75) Inventors: Dikran Babikian, Glendale, CA (US); Nancy Toyne, Tujunga, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 0 days.

(21) Appl. No.: 11/475,272

(22) Filed: Jun. 26, 2006

(65) Prior Publication Data

US 2007/0075579 A1 Apr. 5, 2007

Related U.S. Application Data

(63) Continuation-in-part of application No. 29/238,102, filed on Sep. 9, 2005, now Pat. No. Des. 546,081.

(51) Int. Cl.
*A47C 1/00* (2006.01)
*A47C 5/12* (2006.01)
*A47C 31/00* (2006.01)

(52) U.S. Cl. ..... 297/448.1; 297/451.11; 297/183.1

(58) Field of Classification Search ..... 297/448.1, 297/451.11, 118, 148, 449.1, 447.4, 447.3, 297/447.2, 447.1, 451.12, 445.1, 446.1, 183.1
See application file for complete search history.

(56) References Cited

U.S. PATENT DOCUMENTS

| | | | | |
|---|---|---|---|---|
| 4,082,349 | A | | 4/1978 | Ballenger |
| D248,516 | S | * | 7/1978 | Johansson ..... D6/335 |
| 5,087,097 | A | | 2/1992 | Hehn |
| 5,238,291 | A | | 8/1993 | Alionis |
| D358,494 | S | | 5/1995 | Baerenwald et al. |
| 5,413,399 | A | | 5/1995 | Myers et al. |
| D386,911 | S | | 12/1997 | Perego |
| D393,372 | S | * | 4/1998 | Turner ..... D6/339 |
| 5,806,922 | A | | 9/1998 | Mendelovich |
| 5,927,805 | A | * | 7/1999 | Hilger et al. ..... 297/239 |
| 6,074,007 | A | | 6/2000 | Helmsderfer et al. |
| 6,082,814 | A | | 7/2000 | Celestina-Krevh et al. |
| 6,082,822 | A | * | 7/2000 | Kelly et al. ..... 297/448.1 |
| D442,789 | S | | 5/2001 | Presnell et al. |
| 6,659,544 | B2 | | 12/2003 | Hollett et al. |
| 6,938,952 | B2 | | 9/2005 | Dauterive |
| 2003/0057745 | A1 | | 3/2003 | Dauterive |
| 2003/0098597 | A1 | | 5/2003 | Hollett et al. |
| 2005/0248186 | A1 | | 11/2005 | Wang |

OTHER PUBLICATIONS

Koala Kare Products, New Koala Designer High Chair, Product No. KB105-02, on sale, posting: Sep. 2005, http:www.babychangingstations.com.

* cited by examiner

*Primary Examiner*—Milton Nelson, Jr.
(74) *Attorney, Agent, or Firm*—Christie, Parker & Hale, LLP

(57) ABSTRACT

A high chair includes a pair of laterally spaced apart support structures, with each support structure including an upper portion that defines an armrest and a lower portion that defines a pair of longitudinally spaced apart legs. The high chair also includes a backrest that extends between the rear portions of each support structure and may be connected to the support structures. The backrest includes an upper portion that is higher in height than the height of a front portion of the armrests. The high chair pivots forward about the front portions of the armrests and collapses to tipped position if it is placed in an upside down position such that it rests on the ground or any substantially horizontal surface.

12 Claims, 4 Drawing Sheets

HIGH CHAIR

RELATED APPLICATIONS

The present application is a continuation-in-part of U.S. Design application Ser. No. 29/238,102, filed Sep. 9, 2005 now U.S. Pat. No. D,546,081.

FIELD OF THE INVENTION

The present disclosure generally relates to furniture, and more particularly, to a high chair.

BACKGROUND

High chairs are used to place children in a seated position at a comfortable height at a table for eating, playing, drawing, or other activities. A variety of high chairs are available, one of which is a high chair that is independently supportable with legs. Such high chairs typically include support legs that are of such height so as to place the seat part of the chair at the proper elevation. To prevent a child from climbing out and/or possibly falling out of the high chair, a backrest, a pair of armrests, and a front support member are provided. The armrests and the backrests are high so that a child cannot fall out of the high chair. Additionally, the front support member prevents a child from sliding or falling out of the front of the high chair. Most high chairs also include some type of restrain mechanism, such as seat belts, to prevent a child from climbing out of the high chair.

Besides being used in residential settings, high chairs are also used in commercial establishments such as restaurants. Restaurant high chairs are typically stackable so as to conserve storage space. Additionally, these high chairs are simple in construction and do not have the convenient mechanisms of personal high chairs, such as height adjustment, reclining features, removable eating tray, and the ability to fold or collapse for storage. Restaurant high chairs are typically constructed from wood and include four legs, a backrest, a seat area, a foot support bar, a front support bar, and armrests. Additionally, the longitudinally aligned rear and front legs of these high chairs are typically connected by a support brace.

Restaurant high chairs may be placed on the ground in an upside down orientation. In such a position, the high chair can be stably maintained on the backrest and the armrests, and possibly the front support bar. These high chairs are typically used in such an upside down position in order to support a child's car seat. In the upside down position, the child's car seat can be placed and rested in the space between the legs.

The height of restaurant high chairs is such that a child is generally placed at a proper height when sitting in the high chair, which is placed near a table. Such height typically positions the top of the arm rests at or above the height of the table. Accordingly, the closest a high chair can be placed relative to a table is a position where the front part of the arm rests contact the edge of the table. As a result, a child must bend forward to reach the food that is placed on the table. Additionally, restaurant high chairs do not have a tray. Accordingly, if the child drops or spill the food during eating, the food will fall on his lap or legs because of the distance between the child and the table.

The function of the foot support bar is to allow a child to rest his or her feet while sitting in the high chair. However, the foot support bar can encourage or allow a child to engage in unsafe play. A child can use the foot support bar to stand. Accordingly, if the child bends too far forward, backward or sideways, the high chair may tip and possible collapse. A child can also use the foot support bar to stand and try to get out of the high chair. In such a scenario, the high chair can tip and collapse as described, or the child may fall out of the high chair.

Regarding the side support braces of typical restaurant high chairs, when these chairs are being carried, a person typically holds one of the armrests of the chair and rests the upper part of the chair on his or her hip. Accordingly, the support brace contacts the person's legs. As a result, the lateral movement of the high chair caused by the person walking with the high chair causes repeated impact between the person's leg and the support brace. Additionally, carrying the high chair with the support brace contacting a person's leg moves the center of gravity of the person from his or her spine to an ergonomically unsafe position that may cause back injury. Furthermore, the support brace may encourage a child or be used by a child to climb into the high chair. Depending on the weight of the child, the high chair may pivot sideways and collapse to possibly injure the child.

Furthermore, inverting the current restaurant-type high chairs to support a child's car seat creates unsafe circumstances. For example, because the upper part of the high chair may be much narrower than the space between the legs, placing a child's car seat between the legs of the high chair shifts the center of gravity of the high chair upward, thereby creating an unstable platform. Accordingly, the high chair and the child's car seat may collapse and cause injury to the child. Additionally, the wide space between the legs can obstruct walkways between tables in commercial establishments, such as restaurants.

In view of the above, there is a need for a high chair that can remedy one or more of the above described problems associated with current high chairs.

SUMMARY OF THE INVENTION

In accordance with one aspect of the present disclosure, a high chair includes a pair of laterally spaced apart support structures, a backrest and a seat. Each support structure includes an upper portion defining an armrest, and a lower portion defining a pair of longitudinally spaced apart legs. Additionally, each armrest includes a curved front portion. The backrest extends between the upper portions of the support structures and is connected to the support structures. The backrest has an upper portion with a height greater than a height of the curved front portion of each armrest. The seat extends between the support structures below the upper portion of the backrest and is connected to the support structures. The high chair is unstable in an upside down position causing the high chair to pivot about the curved front portion of the armrests from the upside down position to a tipped position. The upside down position is defined by the upper portion of each armrest and the upper portion of the backrest being placed on a substantially horizontal surface.

In accordance with another aspect of the present disclosure, a high chair includes a pair of laterally spaced apart support structures, a backrest and a seat. Each support structure includes an upper portion defining an armrest having a front portion, and a lower portion defining a pair of longitudinally spaced apart legs having a unobstructed space therebetween. The backrest extends between the upper portions of the support structures and is connected to the support structures. Additionally, the backrest includes an upper portion having a height greater than a height of the front portion of each armrest. The seat extends between the support structures below the upper portion of the backrest and is connected to the support structures.

In accordance with another aspect of the present disclosure, a high chair includes a pair of laterally spaced apart support structures, a backrest and a seat. Each support structure includes an upper portion defining an armrest, and a lower portion defining a pair of longitudinally spaced apart legs. The backrest extends between the upper portions of the support structures and is connected to the support structures. Additionally, the backrest includes an upper portion having a height greater than a height of a front portion of each armrest. The seat extends between the support structures below the upper portion of the backrest and is connected to the support structures. At least one of the upper portion of each armrest and the backrest includes a cut-out defining a handle.

DETAILED DESCRIPTION OF THE INVENTION

Figure 1:
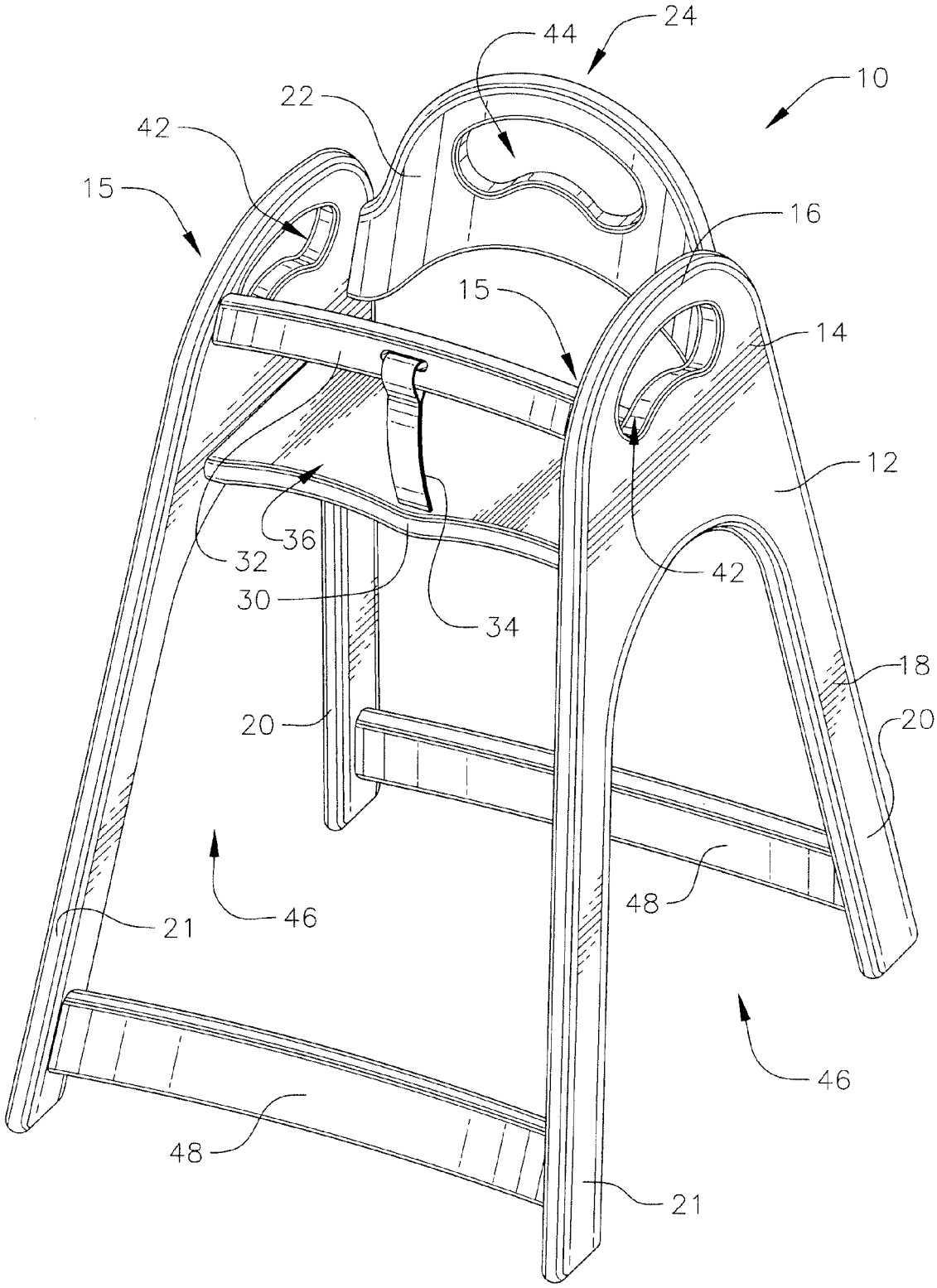
FIG. 1 is a perspective view of a high chair constructed in accordance with the teachings of the present disclosure.
Figure 2:
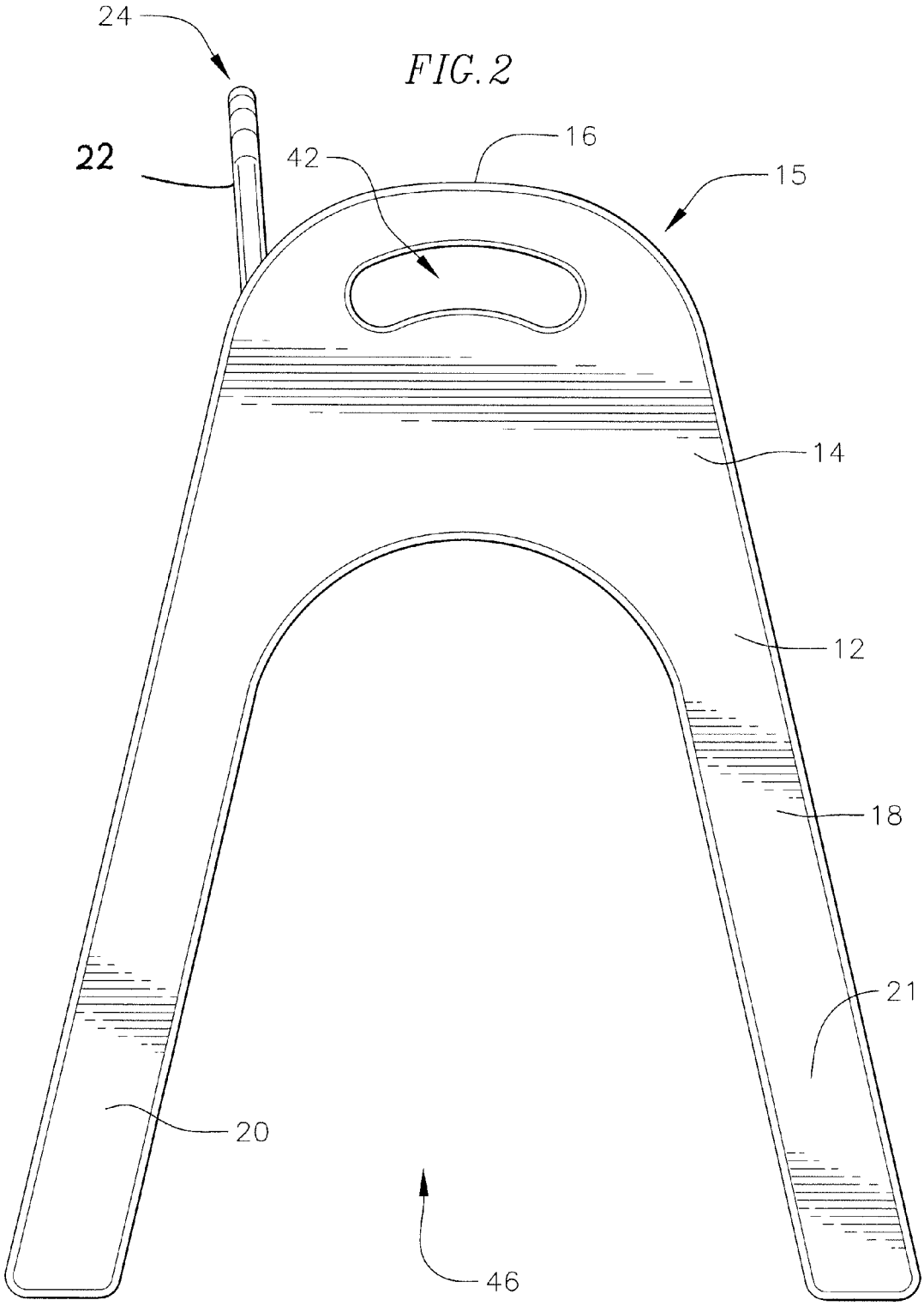
FIG. 2 is a side view of the high chair of FIG. 1.
Figure 3:
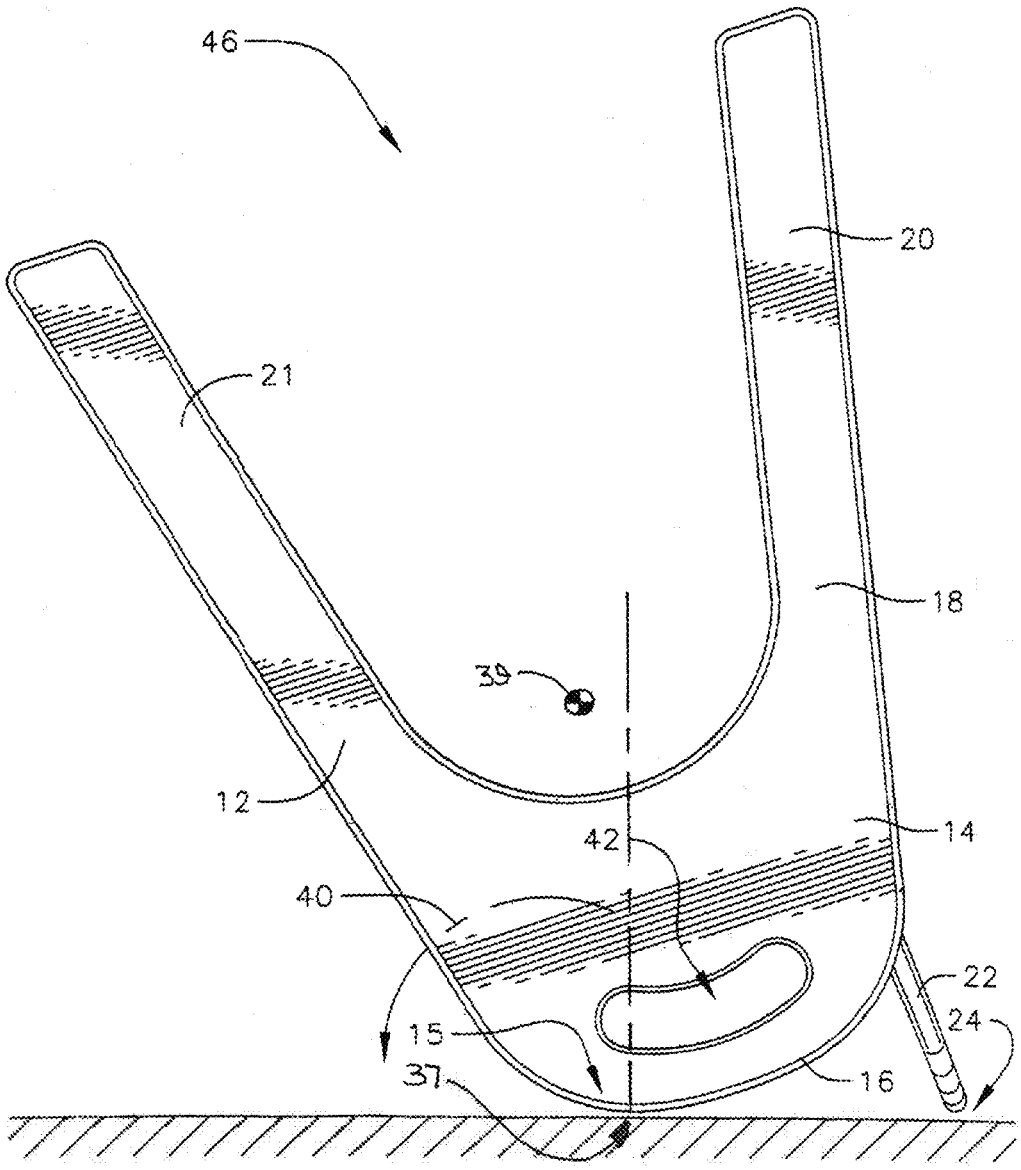
FIG. 3 is a schematic view of the high chair of FIG. 1 shown in an upside down position.

Referring to FIGS. 1-4, a high chair 10 constructed in accordance with the teachings of the present disclosure is shown. The high chair 10 includes a pair of laterally spaced apart support structures 12. Each support structure 12 includes an upper portion 14 that defines an armrest 16. Additionally, a lower portion 18 of each support structure 12 defines a pair of longitudinally spaced apart legs 20 and 21, which may be referred to herein as the rear leg 20 and the front leg 21. The high chair 10 also includes a backrest 22 that extends between the rear portions of each support structure 12 and may be connected to the support structures 12. The backrest includes an upper portion 24 that is higher in height than the height of a front portion 15 of the armrests 16. Referring to FIG. 3, the high chair 10 of the present disclosure cannot be maintained in an upside down position such that it rests on the ground or any horizontal surface on the backrest 22 and the armrests 16, because any attempt to do so will cause the high chair 10 to pivot forward about the front portions 15 of the armrests 16 from the upside down position (shown in FIG. 3), which is an unusable position of the high chair 10 to a tipped position (shown in FIG. 4). Therefore, the high chair 10 of the present disclosure cannot maintained in an upside down position so as to receive and support a child seat between the support structures 12 and the legs 20, 21.

The high chair 10 includes a seat 30 that is positioned horizontally when the high chair 10 is in use and is disposed below the armrests 16 and the upper portion 24 of the backrest 22 and above the legs 20, 21. A child can be placed in the seat 30 with his or her back again the backrest 22. Because the seat 30 is lower than the backrest 22 and the armrests 16, the armrests 16 and the backrest 22 will contain the child and prevent the child from falling out from the sides of the high chair 10 or the back of the high chair 10. To prevent the child from falling out of the seat 30 from the front of the high chair 10, the high chair 10 may also include a support bar 32 that is positioned to be disposed near the waist of the child when the child is seated on the seat 30. The bar 32 prevents the child from falling out of the high chair 10 from the front of the high chair 10. However, the child may still slide through the gap between the bar 32 and the seat 30 and fall out of the high chair 10. To prevent such sliding and falling, the high chair 10 may also include a vertical support 34 that is disclosed herein to be a strap 34. The vertical support 34, however, can be constructed from any material and be flexible or rigid. The strap 34 with the bar 32 and seat 30 define a pair of leg holes 36, through which the child's legs can be inserted when placed on the seat 30. Even though not shown, the high chair 10 may also include a safety belt that can be buckled around the child's waist when the child is placed in the high chair 10.

Figure 4:
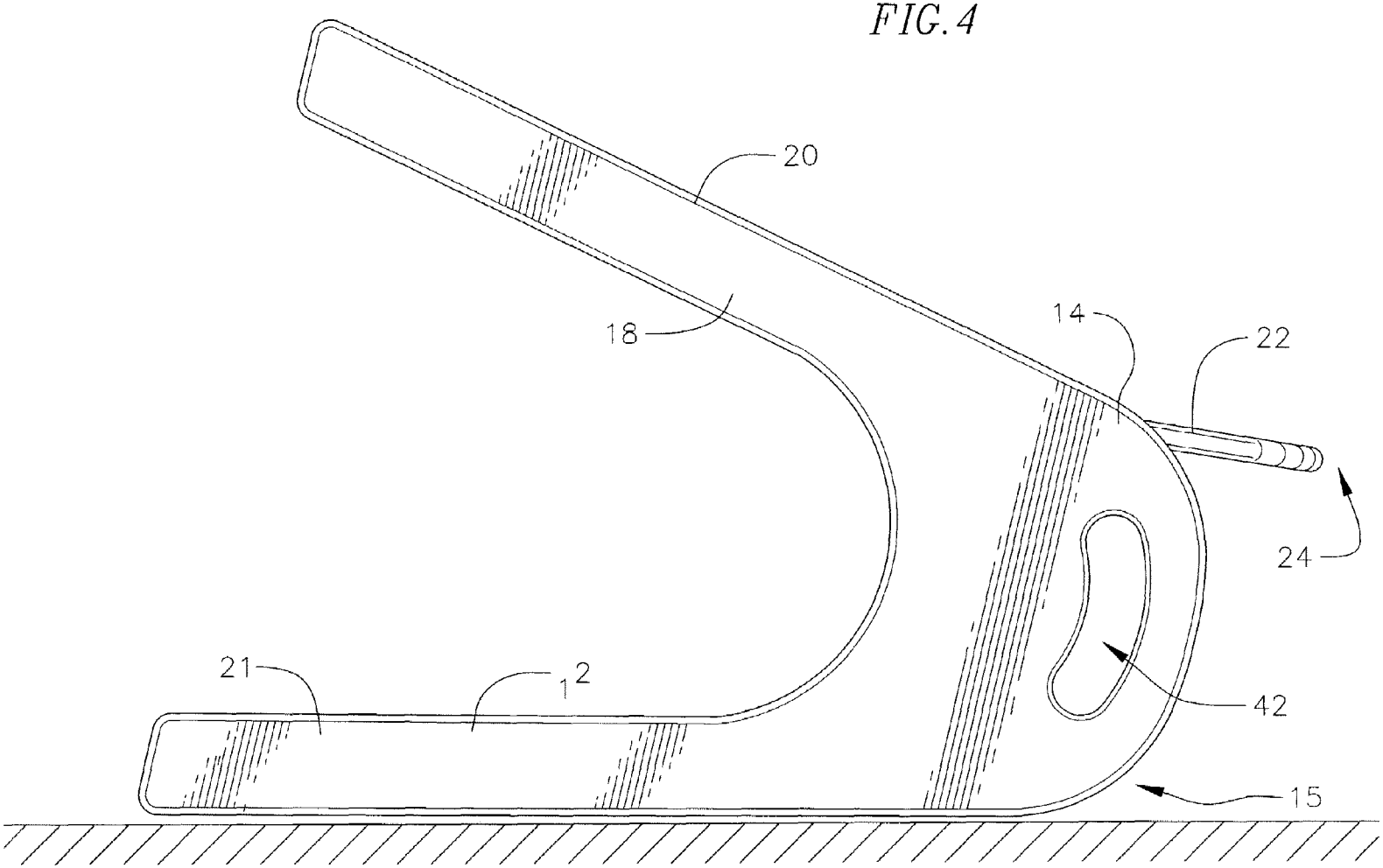
FIG. 4 is a schematic view of the high chair of FIG. 2 in a tipped position.

Referring back to FIG. 3, the height of the backrest 22 at the upper portion 24 relative to the height of the front portion 15 of the armrests 16 is such that when the high chair 10 is placed in an upside down position in an attempt to balance the high chair on a horizontal surface, the high chair pivots forward as shown in FIG. 3 at a location of contact 37 between the armrests 16 and the horizontal surface in the direction of the arrow 40 to the tipped position, as shown in FIG. 4, and cannot be maintained in the upside down position. As shown in FIG. 3, the height difference between the backrest 22 and the front portion 15 of the armrests 16 tips the high chair in the direction of the arrow 40 so much so that it shifts the center of gravity 39 of the high chair in a forward direction. The shifting of the high chair's center of gravity is such that it can no longer be balanced in the upside down position.

To further facilitate such pivoting of the high chair 10 along the arrow 40 as described, the front portions 15 of each armrest 16 can be curved. Such curvature on the armrests 16 facilitates rotation in the direction of the arrow 40 at the location of contact 37 when the high chair 10 is placed is turned upside down and rested in the upside down position. The curved front portion 15 also increases the contact area between the front portion 26 of the armrest 16 and the ground, thereby reducing the friction on the portions of the armrest 16, i.e., front portion 15 that is in contact with the ground. Therefore, the curved front portion 15 of the armrests 16 in combination with the height difference between the curved front portions 15 and the upper portion 24 of the backrest 22 provide free pivoting of the entire high chair 10 about the curved front portion 15 of the armrests 16 when any attempt is made to balance the high chair on a horizontal surface in an upside down position. Additionally, the curved front portion 15 of the armrests 16 allow the front part of the high chair 10 to be pushed under a table so as to place a child closer to the table. As a result, a child can use the surface of the table comfortably without having to bend forward to reach objects that may be on the table. Also, any food that spills during eating may most likely spill on the table because the gap between the child and the table may be narrow. The curve of the front portion 15 may be a smooth curve or a discreet curve where a plurality of lines arranged along a curved path form the shape of the front portion 15.

The high chair 10 may be used in a commercial setting such as a restaurant. Accordingly, several high chairs may have to be stacked on top of each other in order to reduce storage space. Additionally, the high chairs have to be easily movable by the restaurant staff or customers when one is needed for a child. To provide stackability for the high chair 10, the support structures 12 are angled toward each other as shown in FIG. 1. The distance between the lower portions 18 of the support structures 12 is larger than the distance between the upper portions 14 of the support structure 12. This change in distance may be gradual as shown in FIG. 1, or be discreet (not shown). Accordingly, the space between the support structures 12 below the seat is large enough and tapered such that it can receive the backrest 22, the armrests 16, and in general any part of the upper portion 14 of another high chair 10 so that two high chairs can be stacked on top of each other. This stacking capability can be repeated in order to stack a large number of high chairs.

The high chair 10 may include at least one handle or preferably more than one handle so that it can be easily moveable. In the disclosed example, the high chair 10 includes a handle 42 in each armrest 16 and a handle 44 in the backrest. The two handles 42 and the armrests 16 allow a user to approach a high chair from the front or back of the high chair, grab the handles 42, and lift the high chair. The handle 44 in the backrest 22 allows a user to grab the handle 44 from the back of the high chair and lift the high chair. However, the high chairs can be moved by a person grabbing one handle 42 in one of the armrests 16 and holding the high chair 10 against his or her waist.

To prevent any part of the support structure 12 interfering with the person's legs and to further prevent possible back injury to a person carrying the high chair on his or her side, the support structure 12 does not have any structural members that connect the rear leg 20 to the front leg 21. As shown in FIGS. 1 and 2, the space 46 between the legs 20, 21 is completely unobstructed. Accordingly, when a person is resting the upper portion 14 of the high chair 10 is near his or her waist while holding on to the handle 42 of the armrest 16, the lower portion 18 pivots toward the person such that the person's legs will be partially disposed in the space 46. In other words, when the person is carrying the high chair on his or her side while holding handle 42, the lower portion 13 of the support structure 12 envelops the person's legs so as to make the carrying of the high chair 10 ergonomically safe. Additionally, the lack of any side support braces connecting the rear leg 80 to the front leg 21, a child cannot use any part of the support structure 12 as a foot hold or leverage point to climb into the high chair 10. The high chair 10 may include, however, a pair of support braces 48, with each support brace 48 connecting the rear legs 20 of the support structures 12 and the front legs 21 of the support structures 12. To prevent a child from standing in the high chair 10, and possibly falling out of the high chair 10, the high chair 10 does not have a foot support bar in front thereof. Thus, a child cannot use any structure in front of the high chair 10 for leverage to climb out of the high chair 10.

Each of the above components of the high chair 10 may itself be constructed from multiple components or be constructed as a one-piece component. In the disclosed example, the support structures 12 are constructed in one piece such that the armrest 16 and the legs 20, 21 are continuous and define a single component. To provide the rigidity for each support structure 12 in the absence of any support members connecting the rear leg 20 to the front leg 21, the portion of the support structure wherein the rear leg 20 meets the front leg 21 may be arched. Accordingly, the one-piece construction of each support structure 12 in combination with the arched connection between the rear leg 20 and the front leg 21 allows each support structure 12 to have an unobstructed space 46 between the rear leg 20 and the front leg 21. As shown in FIGS. 1 and 2, the backrest 22 and the seat 30 are also each constructed from a one-piece part. The backrest 22 can be attached to the support structures 12 by any type of fastener or fastening method such as screws, nails, adhesives or the like, such as screws or adhesive. Similarly, the seat 30 may be attached to the support structures 12 by any type of fastener or fastening method such as screws, nails, adhesives or the like.

The support structures 12, the backrest 22, the seat 30, the bar 32 and the support braces 48 may be constructed from any material that can provide support for the weight of a child. For example, the noted components of the high chair 10 may be constructed from wood, metal, composite materials or plastics. In the disclosed example, the high chair 10 and all of the above-described components thereof are constructed from high density polyethylene. High density polyethylene allows the above-described components of the high chair to be molded as one-piece parts with in any shaped desired and with any cutouts desired. Additionally, high density polyethylene is durable and is not porous so as to allow liquids and food that may spill on the high chair 10 to be absorbed therein. In other words, the high chair 10 constructed from high density polyethylene is easily cleanable with water or other solutions. Additionally, the high density polyethylene provides the rigidity that when constructed in the high chair 10 shown can support the weight of the child while having sufficient weight so as to provide a stable platform so that the child can not easily pivot or tilt the high chair and collapse the high chair upon sudden movement while seated in the high chair.

The handles 44 and 46 can be separate handles that are constructed from any material and be attached to the support structures 12 and the backrest 22, respectively. However, because the support structure 12 and the backrest 22 are constructed as one-piece parts, the handles 44 and 46 may be defined by cutout portions of the support structure 12 and the backrest 22, respectively. Accordingly, as shown in FIGS. 1 and 2, the handles 44 and 46 may have a curved cut-out shape so as to be comfortable when grabbed and held by a user carrying the high chair.

From the foregoing, it will be appreciated that a high chair constructed in accordance with the teachings of the present disclosure prevents use thereof in an upside down position. Additionally, the high chair does not have any structural supports obstructing the space between the legs thereof so as to be easily carried on a person's side. While a particular form of the disclosure has been illustrated and described, it will be apparent that various modifications can be made without departing from the spirit and scope of the disclosure. Accordingly, it is not intended that the disclosure be limited, except as by the appended claims.

What is claimed is:

1. A high chair comprising:

a pair of laterally spaced apart support structures, each support structure comprising an upper portion defining an armrest, and a lower portion defining a pair of longitudinally spaced apart legs, each armrest having a curved front portion;

a backrest extending between the upper portions of the support structures and being connected to the support structures, the backrest having an upper portion having a height greater than a height of the curved front portion of each armrest;

a seat extending between the support structures below the upper portion of the backrest and being connected to the support structures;

wherein when the high chair is in an upside down position, the curved front portion of the armrest contacts the ground at a location of contact between the armrest and the ground and the upper portion of the backrest contacts the ground; and wherein in the upside down position, a center of gravity of the high chair is located forward of the location of contact such that the high chair is unstable in the upside down position causing the high chair to pivot about the curved front portion to a tipped position.

2. The high chair of claim 1, wherein a space between the pair of longitudinally spaced apart legs is unobstructed.

3. The high chair of claim 1, wherein the space between the pair of support structures at the lower portion of the support structures is greater than a space between the armrests.

4. The high chair of claim 1, further comprising a pair of support braces extending between the support structures, each support brace being connected to laterally aligned legs of the support structures.

5. The high chair of claim 1, wherein each support structure comprises a continuous one-piece structure.

6. The high chair of claim 1, wherein any one of the support structures, the backrest, and the armrests is constructed from high density polyethylene.

7. The high chair of claim 1, wherein any one of the upper portion of each armrest and the backrest includes a cut-out defining a handle.

8. A high chair comprising:

a pair of laterally spaced apart support structures, each support structure configured as a one-piece flat panel and comprising an upper portion defining an armrest having a front portion, and a lower portion defining a pair of longitudinally spaced apart legs having an unobstructed space therebetween extending a length of the legs;

a front support brace connected to the front legs of each support structure;

a rear support brace connected to the rear legs of each support structure;

a backrest extending between the upper portions of the support structures and being connected to the support structures, the backrest having an upper portion having a height greater than a height of the front portion of each armrest; and a seat extending between the support structures below the upper portion of the backrest and being connected to the support structures wherein the unobstructed space extends from above the front and rear support braces to free ends of the legs.

9. The high chair of claim 8, wherein a distance between the pair of support structures at the lower portion of the support structures is greater than a distance between the armrests.

10. The high chair of claim 8, wherein any one of the upper portion of each armrest and the backrest includes a cut-out defining a handle.

11. The high chair of claim 8, wherein each support structure comprises a continuous one-piece structure.

12. The high chair of claim 8, wherein any one of the support structures, the backrest, and the armrests is constructed from high density polyethylene.

* * * * *